US010468809B2

(12) United States Patent
Zhao et al.

(10) Patent No.: US 10,468,809 B2
(45) Date of Patent: Nov. 5, 2019

(54) ELECTRICAL CONNECTOR HAVING AN IMPROVED SUB SHELL

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/012,377

(22) Filed: Jun. 19, 2018

(65) Prior Publication Data

US 2018/0366862 A1 Dec. 20, 2018

(30) Foreign Application Priority Data

Jun. 19, 2017 (CN) ..... 2017 1 0462055

(51) Int. Cl.
*H01R 13/41* (2006.01)
*H01R 13/506* (2006.01)
*H01R 13/6585* (2011.01)

(52) U.S. Cl.
CPC ..... *H01R 13/506* (2013.01); *H01R 13/41* (2013.01); *H01R 13/6585* (2013.01)

(58) Field of Classification Search
CPC ..... H01R 13/506; H01R 13/6586; H01R 13/6593; H01R 24/60; H01R 13/6585; H01R 13/41; H01R 13/6597
See application file for complete search history.

(56) References Cited

U.S. PATENT DOCUMENTS

| | | | | |
|---|---|---|---|---|
| 8,366,486 | B1 * | 2/2013 | Lan | H01R 24/64 439/607.35 |
| 2010/0112863 | A1 * | 5/2010 | Xiao | H01R 27/02 439/607.27 |
| 2011/0150397 | A1 * | 6/2011 | Yi | G02B 6/3817 385/74 |
| 2014/0017921 | A1 * | 1/2014 | Hsu | H01R 24/60 439/166 |
| 2015/0200504 | A1 * | 7/2015 | Little | H01R 24/60 439/607.55 |

(Continued)

FOREIGN PATENT DOCUMENTS

| | | |
|---|---|---|
| CN | 204597117 | 8/2015 |
| CN | 204947238 | 1/2016 |

(Continued)

*Primary Examiner* — Truc T Nguyen
(74) *Attorney, Agent, or Firm* — Wei Te Chung; Ming Chieh Chang

(57) ABSTRACT

An electrical connector includes: an insulative housing comprising a base portion and a tongue portion extending forwardly from the base portion; two rows of conductive terminals comprising a plurality of first terminals and second terminals and affixed to the insulative housing; a shielding plate sandwiched between the first terminals and the second terminals; a shielding shell enclosing the insulative housing; and a sub shell abutting with the tongue portion and the base portion and contacting with the shielding shell, wherein the sub shell resists against a front surface of the base portion and exposes the tongue portion.

20 Claims, 9 Drawing Sheets

(56) References Cited

U.S. PATENT DOCUMENTS

| | | | | |
|---|---|---|---|---|
| 2015/0214669 | A1* | 7/2015 | Chen | H01R 31/06 439/607.24 |
| 2015/0311636 | A1* | 10/2015 | Chang | H01R 13/6471 439/607.28 |
| 2016/0111821 | A1* | 4/2016 | Lan | H01R 13/646 439/607.01 |
| 2016/0134059 | A1* | 5/2016 | Deng | H01R 13/6581 439/607.01 |
| 2016/0141805 | A1* | 5/2016 | Zhao | H01R 13/504 439/607.01 |
| 2017/0117673 | A1* | 4/2017 | Zhang | H01R 24/60 |
| 2017/0155208 | A1* | 6/2017 | Zhang | H01R 13/5216 |
| 2017/0229799 | A1* | 8/2017 | Little | H01R 13/6471 |
| 2017/0279226 | A1* | 9/2017 | Tsai | H01R 13/502 |
| 2018/0166832 | A1* | 6/2018 | Xu | H01R 13/6588 |
| 2018/0175556 | A1* | 6/2018 | Zhao | H01R 13/6581 |
| 2018/0375263 | A1* | 12/2018 | Zhong | H01R 13/4367 |

FOREIGN PATENT DOCUMENTS

| | | |
|---|---|---|
| CN | 205657270 | 10/2016 |
| CN | 206727341 | 12/2017 |
| TW | M497866 | 3/2015 |
| TW | M512248 | 11/2015 |
| TW | I625006 | 5/2018 |

* cited by examiner

ELECTRICAL CONNECTOR HAVING AN IMPROVED SUB SHELL

BACKGROUND OF THE DISCLOSURE

1. Field of the Disclosure

The present disclosure relates to an electrical connector, and more particularly to an electrical connector adapted for normally and reversely mating with a mating connector.

2. Description of Related Arts

China Patent No. 204597117 discloses an electrical connector including an insulative housing and a grounding plate embedded in the insulative housing. The grounding plate is cut and bent by a metal thin plate to form a shielding plate and a first flat plate. The shielding plate is at least partially positioned on a tongue portion of the insulative housing. The first flat plate is at least partially exposed at a base surface of the insulative housing. The first flat plate extends outwards and is respectively provided with a contact piece. The contact piece is at least partially exposed outside the base of the insulative housing and is electrically connected with a shielding shell.

It is known to provide a sub shell mounted to the insulative housing and contacting with the shielding shell. however, such sub shell is positioned too close to power terminals.

An improved electrical connector is desired.

SUMMARY OF THE DISCLOSURE

An electrical connector comprises: an insulative housing comprising a base portion and a tongue portion extending forwardly from the base portion; two rows of conductive terminals comprising a plurality of first terminals and second terminals and affixed to the insulative housing; a shielding plate sandwiched between the first terminals and the second terminals; a shielding shell enclosing the insulative housing; and a sub shell abutting with the tongue portion and the base portion and contacting with the shielding shell, wherein the sub shell resists against a front surface of the base portion and exposes the tongue portion.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
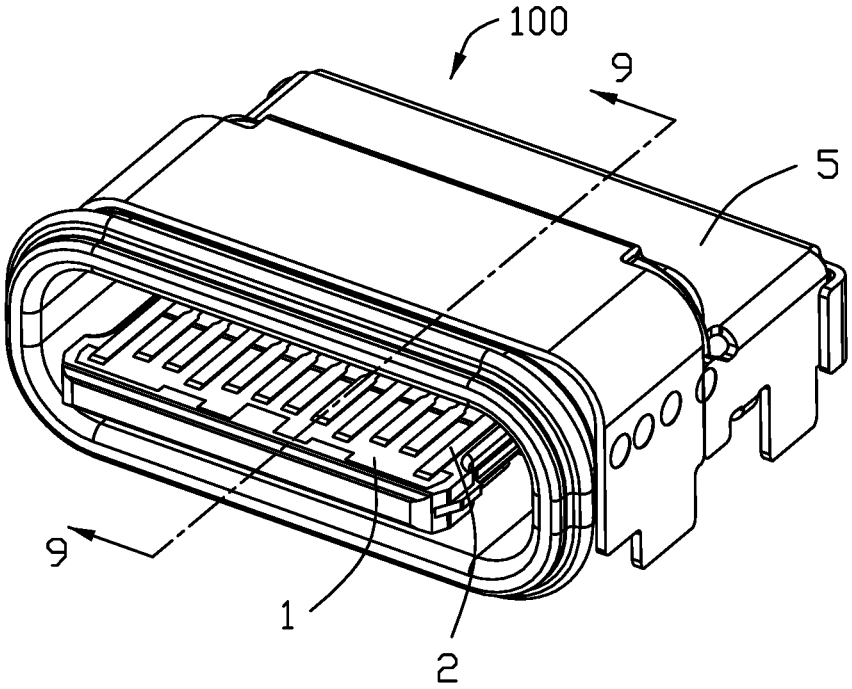
FIG. 1 is a perspective, assembled view of an electrical connector.
Figure 2:
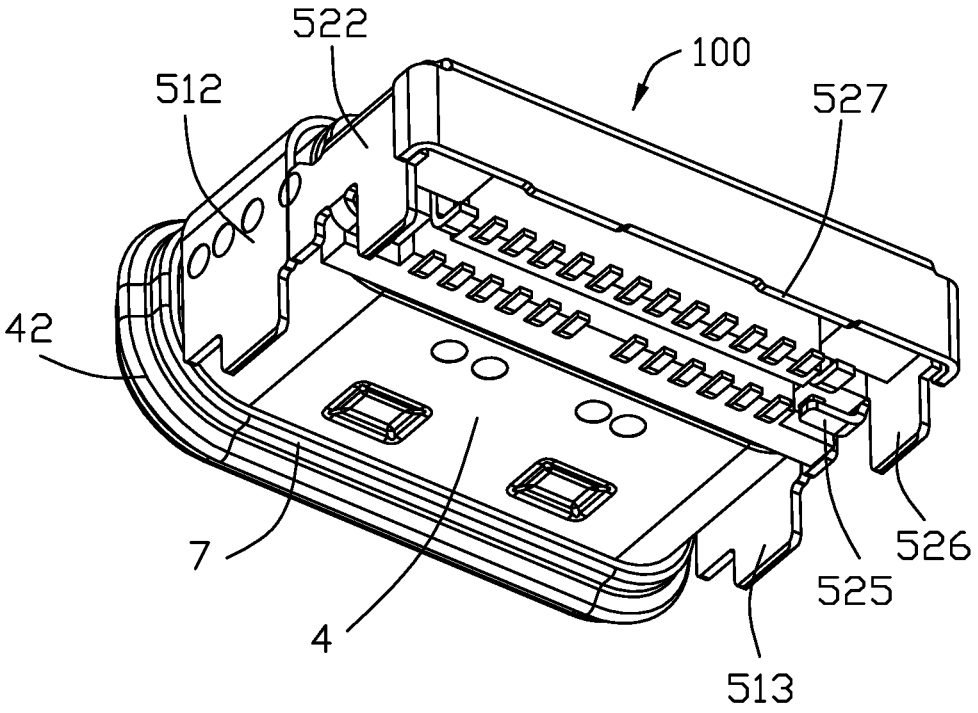
FIG. 2 is another perspective, assembled view of the electrical connector taken from FIG. 1.

Reference will now be made in detail to the embodiments of the present disclosure. The embodiment will be shown in FIGS. 1 to 9. The insert direction of the electrical connector 100 is a front-to-rear direction.

Referring to FIGS. 1 to 9, the electrical connector 100 includes an insulative housing 1, a number of conductive terminals 2 affixed to the insulative housing 1 and commonly forming a contact module, a shielding plate 3 affixed to the insulative housing 1 to define a mating cavity (not labeled) for receiving the plug connector, a shielding shell 4 enclosing the insulative housing 1, an outer metal shell 5 enclosing the shielding shell 4, a sealer 6 sealing a rear end of the insulative housing 1, an o-ring 7 attached to a front end of the shielding shell 4, and a sub shell 8 affixed to the insulative housing 1.

Referring to FIGS. 5 to 8, the insulative housing 1 includes a first insulator 11, a second insulator 12 assembled to the first insulator 11, and a third insulator 13 enclosing the first insulator 11 and the second insulator 12. The first insulator 11 includes a first base 111 and a first tongue 112 extending forwardly from the first base 111. The first base 111 includes a first rear portion 113 located at a bottom of two sides of the first base 111. The first tongue 112 includes a plurality of first tubers 114 located at an upper surface and a plurality of buckling holes 115 located at a front end thereof. The second insulator 12 includes a second base 121 and a second tongue 122 extending forwardly from the second base 121. The second base 121 includes a second rear portion 123 located at a bottom of two sides of the second base 121 and a pair of clapping portions 126 resisting against the first base 111. The second tongue 122 includes a plurality of second tubers 124 located at a lower surface and a plurality of buckling tubers 125 mated with the buckling holes 115. The third insulator 13 includes a third base 131 and a third tongue 132 extending forwardly from the third tongue 131. The third base 131 includes a pair of recesses 134 and a protrusion 135 located between the pair of recesses 134. The third tongue 132 includes a pair of mating grooves 133 mated with a mating connector. The third insulator 13 fills in a gap between the first insulator 11 and the second insulator 12 making the first tubers 114 and the second tubers 124 exposed to the third insulator 13 for enhancing the strength among the first insulator 11, the second insulator 12 and the third insulator 13. The first base 111, the second base 121 and the third base 131 form a base portion. The first tongue 112, the second tongue 122 and the third tongue 132 form a tongue portion exposed within the mating cavity.

Referring to FIGS. 5 to 8, the conductive terminals 2 include a number of first terminals 21 affixed to the first insulator 11 and a number of second terminals 22 affixed to the second insulator 12. Each first terminal 21 includes a first contacting portion 211 exposed to the first tongue 112, a first connecting portion and a first soldering portion 213 extending rearward from the first connecting portion 212. Each second terminal 22 includes a second contacting portion 211 exposed to the second tongue, a second connecting portion 222 and a second soldering portion 223 extending rearward from the second connecting portion 222. The first contacting portion 211 and the second contacting portion 221 are disposed in opposite position. The first soldering portion 213 and the second soldering portion 223 are located in the front-to-rear direction. Each first contacting portion 211 is positioned in reverse symmetry with respect to the second contacting portion 221.

Figure 5:
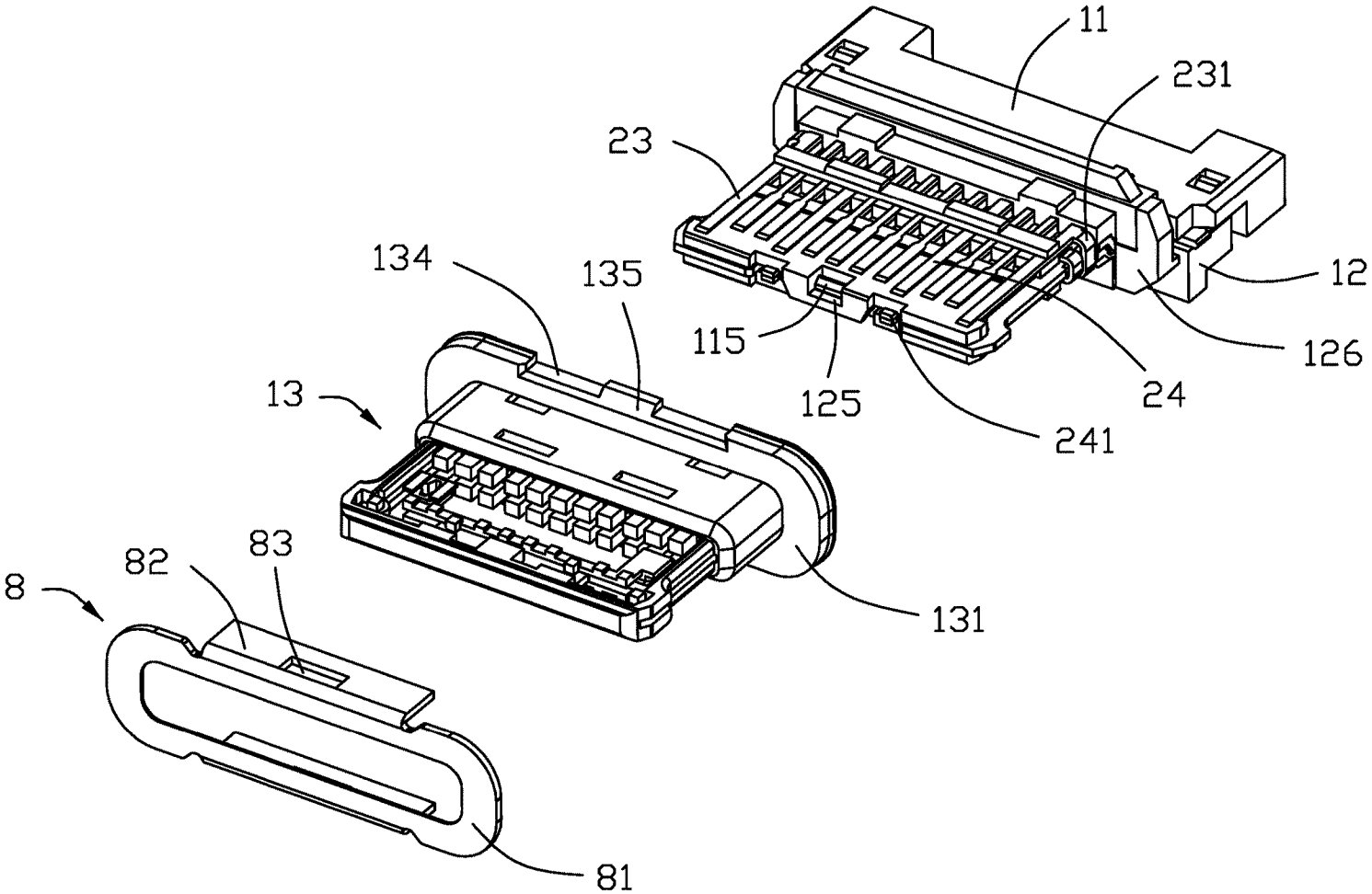
FIG. 5 is an exploded view of an insulative housing, a plurality of conductive terminals, a sub shell and a shielding plate of the electrical connector.
Figure 6:
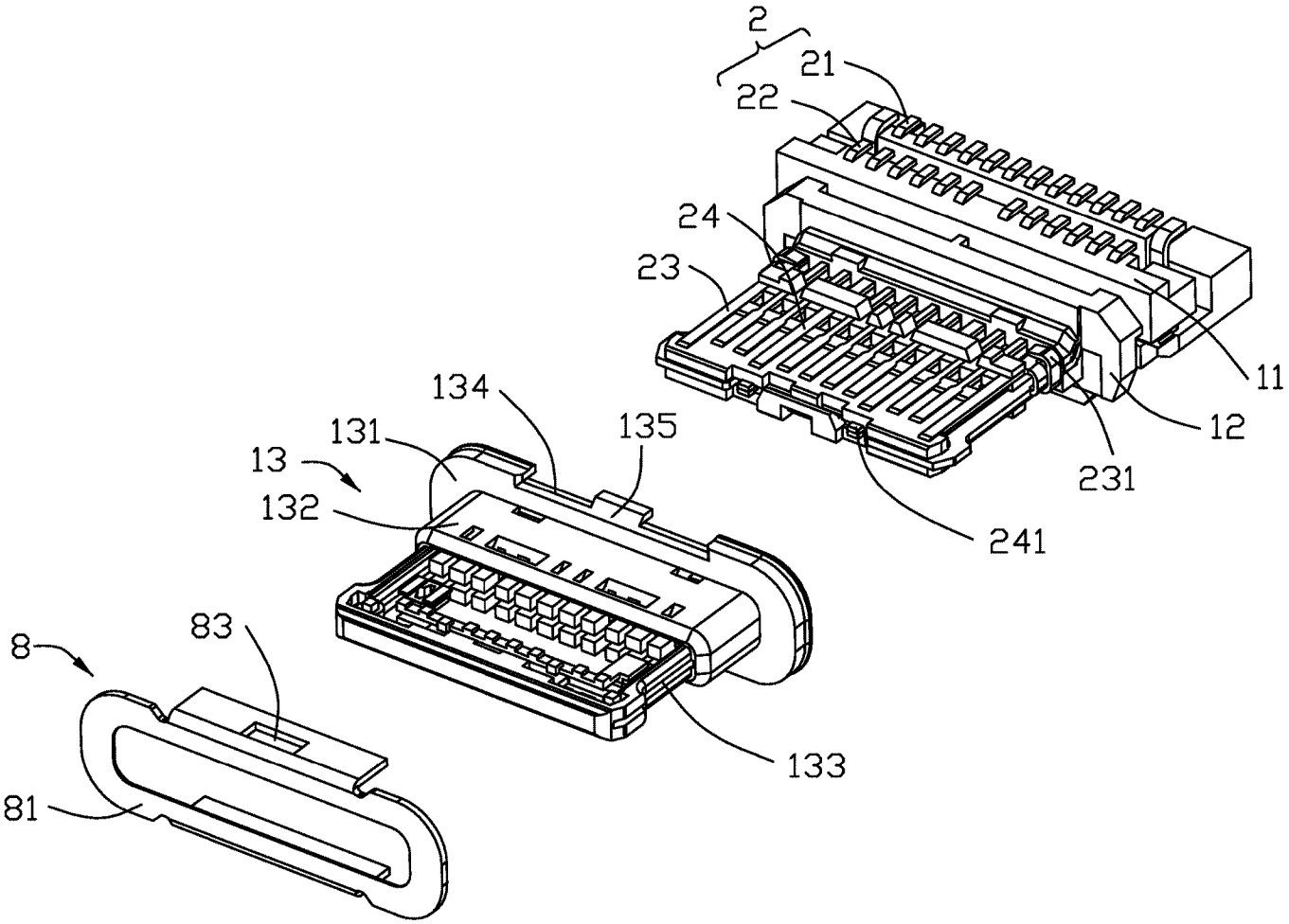
FIG. 6 is another exploded view of the electrical connector taken from FIG. 5.

Each row of conductive terminals 2 include a pair of ground terminals 23 outwardly and a pair of power terminals 24 located between the pair of ground terminals 23. Each ground terminal 23 includes a abutting portion 231 bending towards the shielding plate 3 and then bending inwardly. Referring to FIGS. 5 and 6, the abutting portion 231 of the first terminals 21 and the abutting portion 231 of the second terminals 22 are arranged in the front-to-rear direction. Each power terminal 24 includes a front portion 241 bending towards the shielding plate and located at a free end thereof. The front portion 241 of the first terminals 21 and the front portion 241 of the second terminals 22 resist against each other for strengthening the transmitting current.

Figure 7:
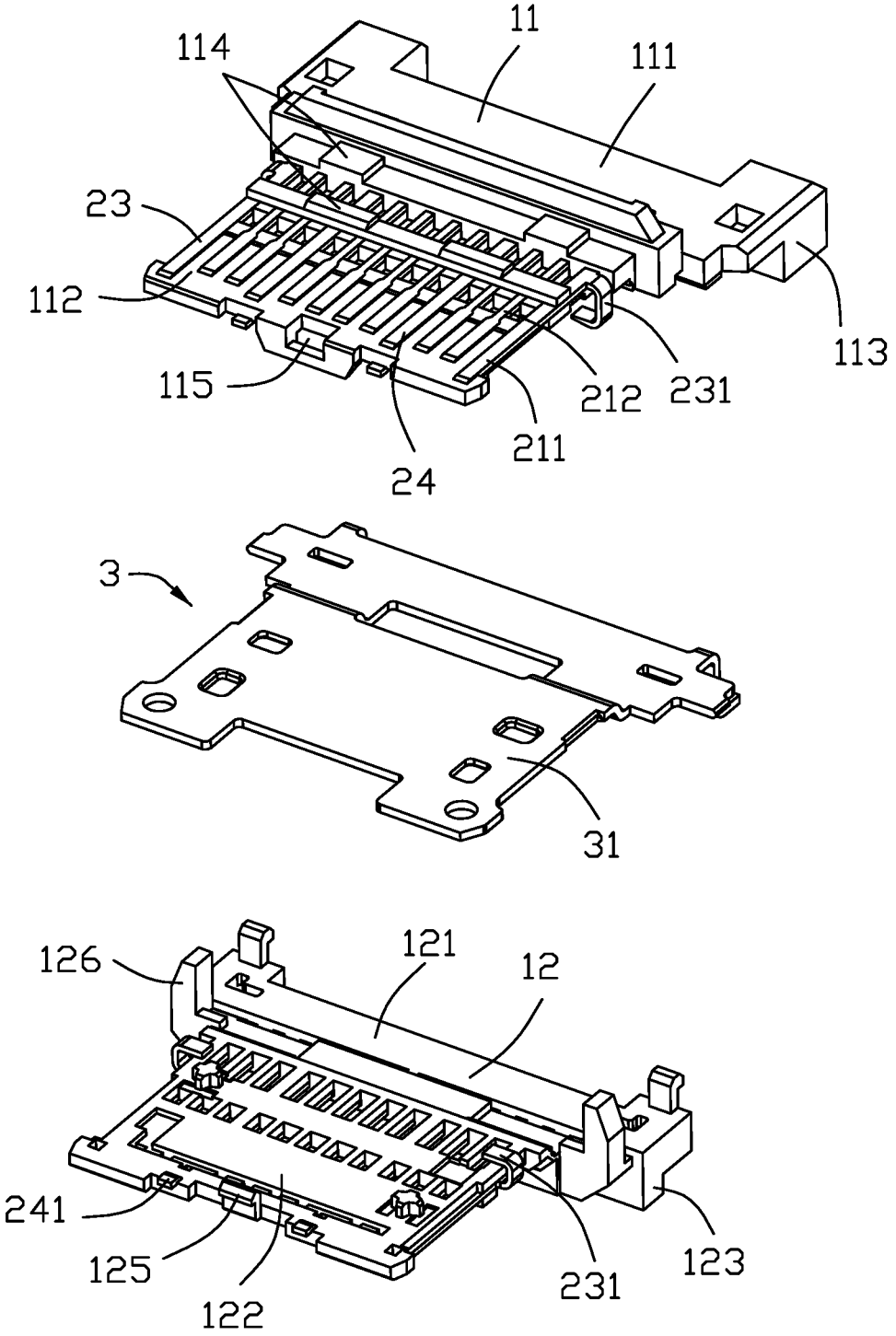
FIG. 7 is an exploded view of the insulative housing, the conductive terminals and the shielding plate of the electrical connector.
Figure 8:
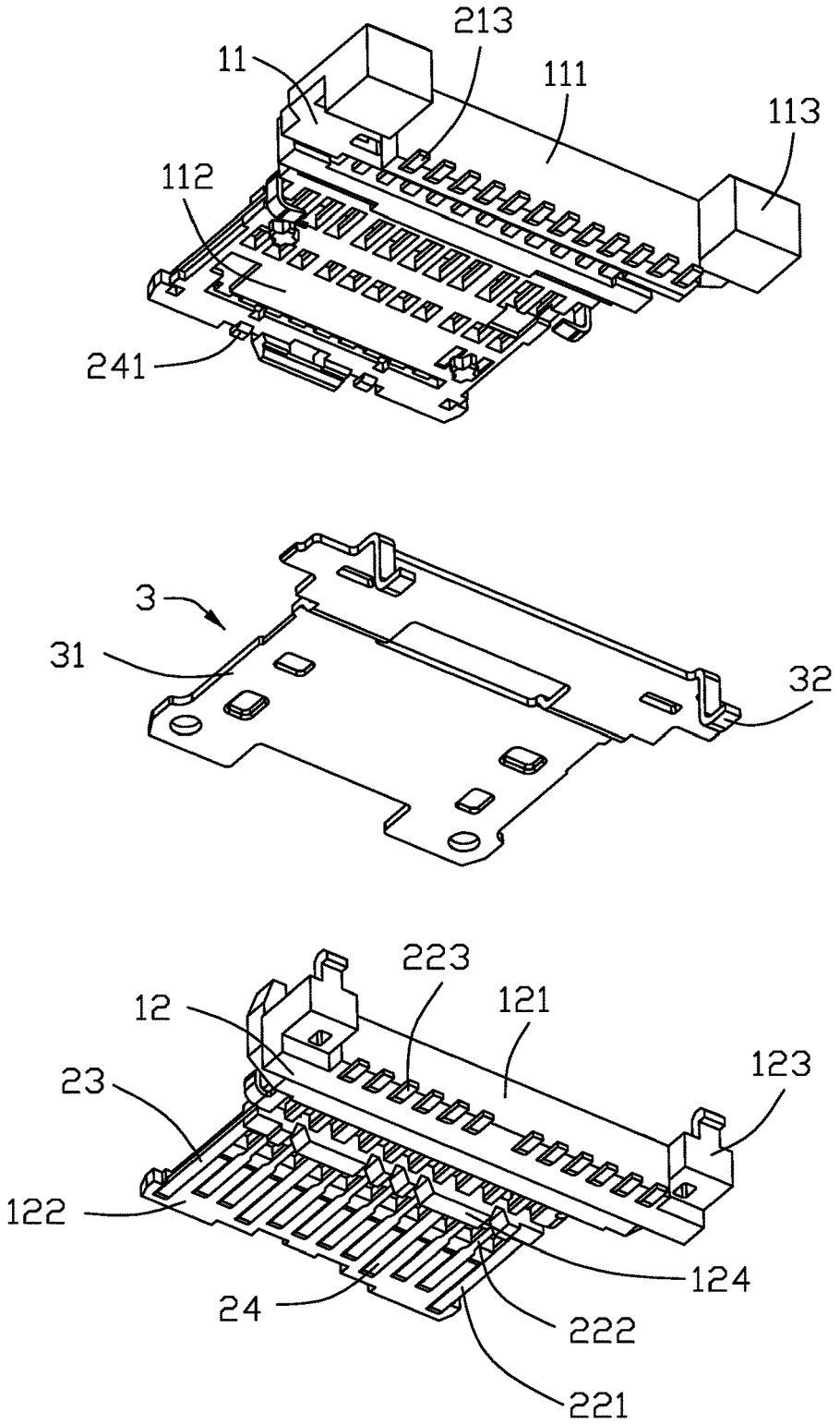
FIG. 8 is another view of the electrical connector taken from FIG. 7.
Figure 9:
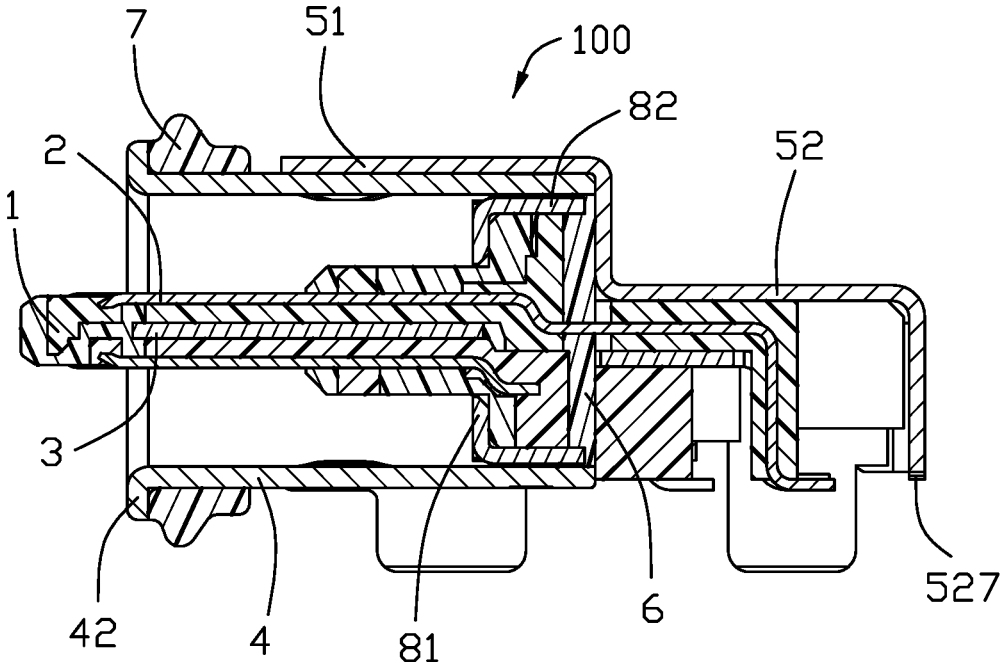
FIG. 9 is a cross-sectional view of the electrical connector taken along line 9-9 in FIG. 1.

Referring to FIGS. 7 to 8, the shielding plate 3 includes a supporting portion 31 affixed to the insulative housing 1, and a soldering pin 32 bending downwardly and then extending rearward from the supporting portion 31.

Referring to FIGS. 1 to 4, the shielding shell 4 includes a main portion 41 shaped as cylindrical shape and a pair of front annular portion 42 located beside the main portion 41. The size of an out edge of the front annular portion 42 is larger than that of the main portion 41.

Referring to FIGS. 1 to 4, the outer metal shell 5 includes a first covering portion 51 attached to a top surface of the shielding shell 4 and a second covering portion 52 forming a covering cavity 520 and enclosing a rear end of the insulative housing 1. The first covering portion 51 includes a top wall 511 attached to the top surface of the shielding shell 4, a pair of lateral walls 512 bending downwardly from two sides of the top wall 511 and attached to two sides of the shielding shell 4, and a first fixing leg 513 extending downwardly from each lateral wall 512. The second covering portion 52 is arranged lower than the first covering portion 51. The second covering portion 52 includes an upper wall 521 enclosing an upper surface of the insulative housing 1, a pair of side walls 522 bending downwardly from the upper wall 521 and connecting with the lateral walls 512, and a rear wall 523 bending downwardly from a rear end of the upper wall 521. The rear wall 523 includes a covering leg 524 extending forwardly and covering the side wall 522. Each side wall 522 includes a locking leg 525 extending inwardly and resisting against a bottom surface of the insulative housing 1 and a second fixing leg 526 extending downwardly from a bottom edge thereof. The rear wall 523 includes a pair of third fixing legs 527. The first fixing legs 513 and the second fixing legs 526 are affixed to a printed circuit board and the third fixing legs 527 are contact with the printed circuit board for ground when the electrical connector 100 is affixed to the printed circuit board.

Referring to FIGS. 1 to 4, there exists a gap between the insulative housing 1 and a rear end of the shielding plate 3 making the sealer 6 sealing a gap between the shielding plate 2 and the conductive terminals 2, and the insulative housing 1 and the shielding shell 4.

Referring to FIGS. 1 to 4, the o-ring 7 is attached to a front end of the main portion 41 and resists against a rear edge of the front annular portion 42.

Figure 3:
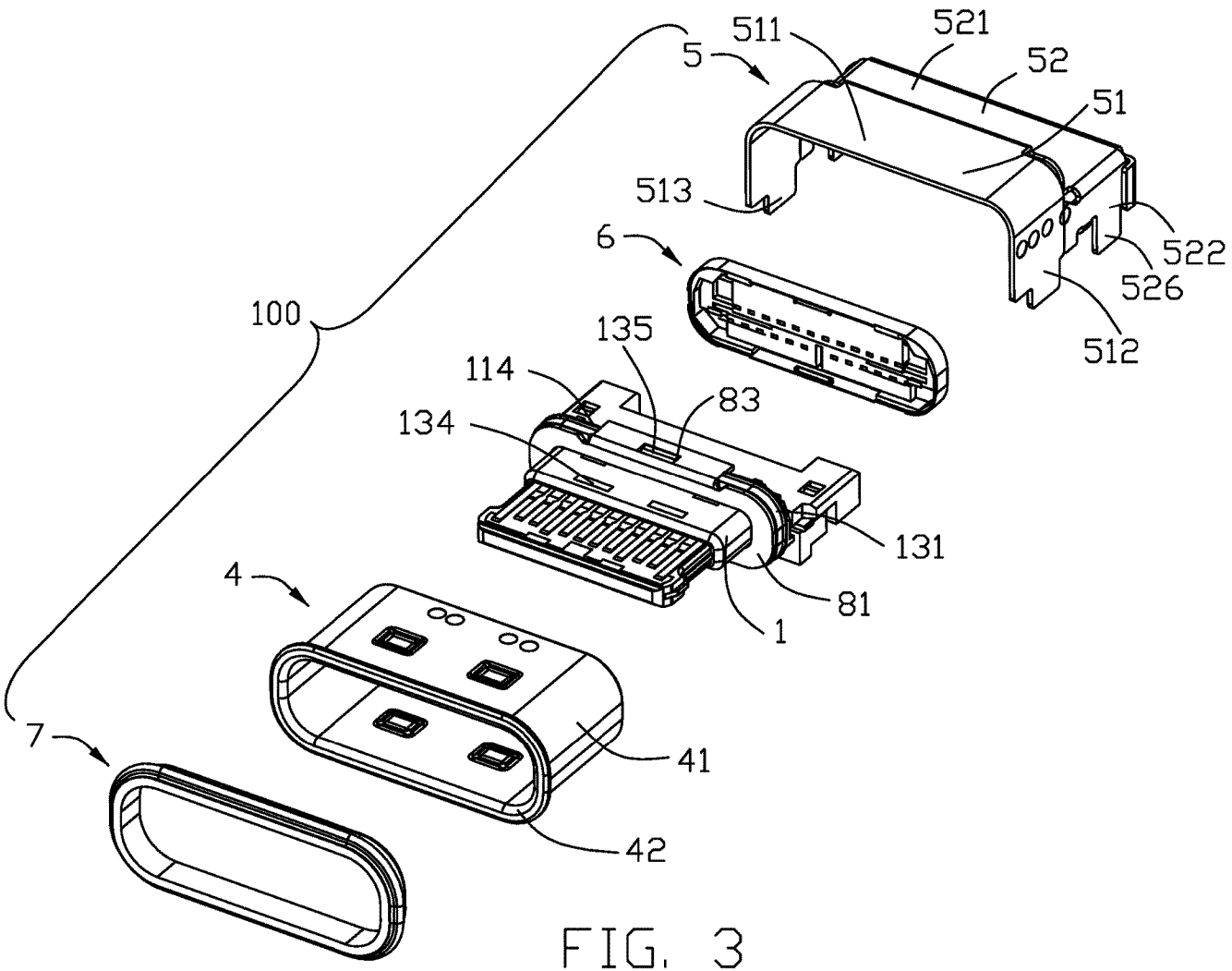
FIG. 3 is a partial exploded view of the electrical connector.
Figure 4:
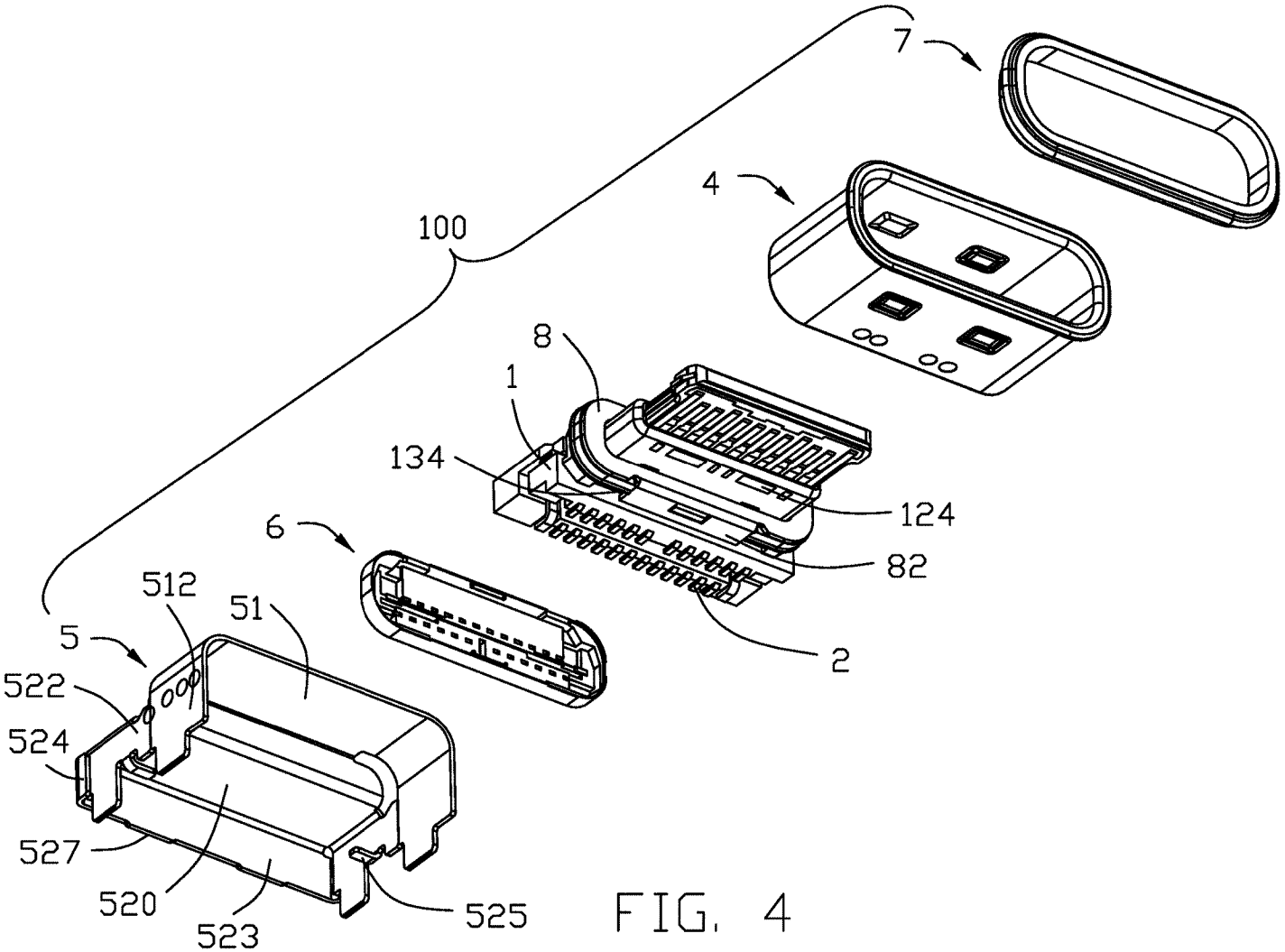
FIG. 4 is another partial exploded view of the electrical connector taken from FIG. 3.

Referring to FIGS. 5 to 6, the sub shell 8 extends in a vertical direction perpendicular to the front-to-rear direction. The sub shell 8 includes a length in a transverse direction perpendicular to the vertical direction, a height in the vertical direction and a thickness in the front-to-rear direction. The sub shell 8 includes a covering part 81 shaped as a cylindrical shape, a pair of fixing pieces 82 extending rearward from an upper edge and a lower edge thereof and a locking hole 83 located at each fixing piece 82. Referring to FIGS. 3 to 4, the covering part 81 is attached to a front surface of the third base 131 by going through the tongue portion. The fixing pieces 82 cover a top surface and a bottom surface of the third base 131 respectively making the protrusions 135 mated with the locking holes 83 and the fixing pieces 82 received in the recesses 134. Two ends of the fixing piece 82 resist against the recess 134. The fixing piece 82 is welded onto the main portion 41 making a better effect of fixing.

Referring to FIGS. 1 to 4, a front portion of the mating connector resists against the covering part 81 when the electrical connector 100 is mated with a mating connector, which makes the strength transmitted to the shielding shell 4 and reducing force on the insulative housing 1 and conductive terminals 2, and preventing damaging the insulative housing 1 and conductive terminals 2 after many times insertion. The sub shell 8 is attached to the insulative housing 1 to enhance the overall binding force. Since the covering part 81 is annularly disposed near the base portion and the tongue portion, the thickness is extremely small enough, and the distance between power terminals 24 and the covering part 81 is far more, it is not easy to cause a fire. In brief, the feature of the invention is to provide the vertical metallic structure, i.e., the covering part 31, for confrontation with the mated plug connector along the front-to-back direction so as to not only lower impact upon the terminal module during mating but also performing shielding effect along the front-to-back direction between the base portion and the mating cavity where the plug connector is received while the covering part 31 is substantially relatively far distanced from the exposed contacting portions of the power contacts on the tongue portion for preventing the potential shorting therebetween when the dust or humidity improperly invades the mating cavity in front of the base portion. Notably, the tongue portion form a front relative thin section and a rear relatively thick section. As shown in U.S. Pat. No. 9,484,681, traditionally the rear thick section is associatively covered/surrounded by the metallic so-called metallic collar to electrically connect to the spring plates on the mated plug connector for grounding. Understandably, in some situations, such the external humidified dust may invade the mating cavity to have the exposed contacting portion of the power contact and the so-called metallic collar shorted together. In this invention, the traditional collar exposed upon the thick section is removed and the vertically extending covering part 81 is to replace the surrounding collar so as to be efficiently spaced form the contacting portion of the power contact, thus assuring no potential shorting therebewteen.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

two rows of conductive terminals comprising a plurality of first terminals and second terminals and affixed to the insulative housing;

a shielding plate sandwiched between the first terminals and the second terminals;

a shielding shell enclosing the insulative housing;

an outer metal shell enclosing the shielding shell; and a sub shell abutting with the tongue portion and the base portion and contacting with the shielding shell, wherein the sub shell resists against a front surface of the base portion and exposes the tongue portion; and the outer metal shell comprises a first covering portion attached to the shielding shell and a second covering portion connected with the first covering portion and forming a covering cavity with the first covering portion, and the second covering portion receives a rear end of the insulative housing.

2. The electrical connector as claimed in claim 1, wherein the sub shell comprises a vertical covering part abutting with the front surface of the base portion.

3. The electrical connector as claimed in claim 2, wherein the sub shell comprises a fixing piece bending rearward from a rear edge of the covering part, and the fixing piece is welded onto the shielding shell.

4. The electrical connector as claimed in claim 3, wherein the fixing piece comprises a plurality of locking holes, and the base portion comprises a plurality of protrusions mated with the locking holes.

5. The electrical connector as claimed in claim 4, wherein the base portion comprises a plurality of recesses located at two ends of the protrusions, and the fixing piece is received in the recess and two ends of the fixing piece resist against an annular wall of the recess.

6. The electrical connector as claimed in claim 1, wherein the second covering portion is located lower than the first covering portion, the second covering portion comprises an upper wall, a pair of side walls bending downwardly from the upper wall and connecting with the first covering portion, a rear wall bending downwardly from a rear end of the upper wall, and a covering leg bending forwardly from the rear wall and covering the side walls, and the upper wall, the side walls, the rear wall, and the covering leg form the covering cavity.

7. The electrical connector as claimed in claim 1, wherein the first covering portion comprises a pair of first fixing legs extending downwardly from two sides thereof, the second covering portion comprises a pair of second fixing legs extending downwardly from two sides thereof and a pair of third fixing legs extending downwardly from a rear end thereof, and the first fixing legs and the second fixing legs are affixed to a printed circuit board and the third fixing legs are in contact with the printed circuit board for grounding.

8. The electrical connector as claimed in claim 1, wherein each row of conductive terminals comprise a pair of outermost ground terminals, each ground terminal comprises an abutting portion bending towards the shielding plate and then extending inwardly, the abutting portions of the pair of outermost ground terminals are arranged in a front-to-rear direction and both contact with the shielding plate.

9. The electrical connector as claimed in claim 8, wherein each row of conductive terminals comprise a plurality of power terminals, each power terminal comprises a front portion extending forwardly towards the shielding plate, and the front portions of the power terminals resist against each other in a vertical direction perpendicular to the front-to-rear direction.

10. An electrical connector comprising:

an insulative housing comprising a base portion and a tongue portion extending forwardly from the base portion in a front-to-back direction, said base portion being larger than the tongue portion in a vertical cross-sectional view perpendicular to said front-to-back direction;

two rows of conductive terminals comprising a plurality of first terminals and second terminals and affixed to the insulative housing, each of said first terminals and second terminals forming a contacting portion exposed upon the tongue portion;

a shielding shell enclosing the insulative housing and forming a mating cavity in which the tongue portion extends;

an outer metal shell being fastened to the shielding shell and having a pair of fixing legs; and a sub shell forming a vertically extending front covering part rearwardly abutting against a front surface of the base portion, and a fixing piece extending rearwardly from the covering part to be mechanically welded and electrically connect to the shielding shell; wherein said front covering part is forwardly exposed to the mating cavity.

11. The electrical connector as claimed in claim 10, wherein the sub shell is further secured to the base portion.

12. The electrical connector as claimed in claim 10, wherein said sub shell forms no part located upon the tongue portion except the front covering part.

13. The electrical connector as claimed in claim 10, wherein the first terminals include power terminals, and the second terminals include power terminals aligned with the power terminals of the first terminals in both electrical and mechanical connection manner.

14. An electrical connector comprising:

an insulative housing comprising a base portion and a tongue portion extending forwardly from the base portion;

two rows of conductive terminals comprising a plurality of first terminals and second terminals and affixed to the insulative housing;

a shielding plate sandwiched between the first terminals and the second terminals;

a shielding shell enclosing the insulative housing; and a sub shell abutting with the tongue portion and the base portion and contacting with the shielding shell, wherein the sub shell resists against a front surface of the base portion and exposes the tongue portion; and each row of conductive terminals comprise a pair of outermost ground terminals, each ground terminal comprises an abutting portion bending towards the shielding plate and then extending inwardly, the abutting portions of the pair of outermost ground terminals are arranged in a front-to-rear direction and both contact with the shielding plate.

15. The electrical connector as claimed in claim 14, wherein the sub shell comprises a vertical covering part abutting with the front surface of the base portion, the sub shell comprises a fixing piece bending rearward from a rear edge of the covering part, and the fixing piece is welded onto the shielding shell.

16. The electrical connector as claimed in claim 15, wherein the fixing piece comprises a plurality of locking holes, and the base portion comprises a plurality of protrusions mated with the locking holes.

17. The electrical connector as claimed in claim 16, wherein the base portion comprises a plurality of recesses located at two ends of the protrusions, and the fixing piece is received in the recess and two ends of the fixing piece resist against an annular wall of the recess.

18. The electrical connector as claimed in claim 14, further comprising an outer metal shell enclosing the shielding shell, the outer metal shell including a first covering portion attached to the shielding shell and a second covering portion connected with the first covering portion and forming a covering cavity with the first covering portion, and wherein the second covering portion receives a rear end of the insulative housing, the second covering portion is located lower than the first covering portion, the second covering portion includes an upper wall, a pair of side walls bending downwardly from the upper wall and connecting with the first covering portion, a rear wall bending downwardly from a rear end of the upper wall, and a covering leg bending forwardly from the rear wall and covering the side walls, and the upper wall, the side walls, the rear wall, and the covering leg form the covering cavity.

19. The electrical connector as claimed in claim 14, further comprising an outer metal shell enclosing the shielding shell, the outer metal shell including a first covering portion attached to the shielding shell and a second covering portion connected with the first covering portion and forming a covering cavity with the first covering portion, and wherein the second covering portion receives a rear end of the insulative housing, the first covering portion includes a pair of first fixing legs extending downwardly from two sides thereof, the second covering portion includes a pair of second fixing legs extending downwardly from two sides thereof and a pair of third fixing legs extending downwardly from a rear end thereof, and the first fixing legs and the second fixing legs are affixed to a printed circuit board and the third fixing legs are in contact with the printed circuit board for grounding.

20. The electrical connector as claimed in claim 14, wherein each row of conductive terminals comprise a plurality of power terminals, each power terminal comprises a front portion extending forwardly towards the shielding plate, and the front portions of the power terminals resist against each other in a vertical direction perpendicular to the front-to-rear direction.

* * * * *